United States Patent [19]

Goldfarb et al.

[11] Patent Number: 4,673,370

[45] Date of Patent: Jun. 16, 1987

[54] TOY FOUR-WHEEL-DRIVE CLIMBING VEHICLE OPERABLE ON LAND, OVER WATER, AND UNDER WATER

[75] Inventors: Adolph E. Goldfarb, 1432 S. East Wind Cir., Westlake Village, Calif. 91361; Delmar K. Everitt, Morro Bay, Calif.; Drew Plakos, Bloomington, Minn.

[73] Assignee: Adolph E. Goldfarb, Northrdige, Calif.

[21] Appl. No.: 827,887

[22] Filed: Feb. 10, 1986

Related U.S. Application Data

[63] Continuation-in-part of Ser. No. 788,052, Oct. 16, 1985, which is a continuation-in-part of Ser. No. 463,999, Feb. 4, 1983, Pat. No. 4,547,166, and a continuation-in-part of Ser. No. 417,554, Sep. 13, 1982, Pat. No. 4,492,058, which is a continuation-in-part of Ser. No. 233,495, Feb. 11, 1981, abandoned, which is a continuation-in-part of Ser. No. 121,645, Feb. 14, 1980, Pat. No. 4,306,375.

[51] Int. Cl.[4] ..... A63H 23/04; A63H 29/22

[52] U.S. Cl. ..... 446/162; 446/160; 446/462; 446/471

[58] Field of Search ..... 446/162, 161, 160, 164, 446/165, 163, 154, 155, 462, 471; 440/11

[56] References Cited

U.S. PATENT DOCUMENTS

| | | | |
|---|---|---|---|
| 1,495,726 | 5/1924 | Cook et al. | 446/164 X |
| 3,011,184 | 12/1961 | Curcio | 440/11 X |
| 3,237,343 | 3/1966 | Blanchard | 446/154 |
| 3,466,798 | 9/1969 | Speers et al. | 446/162 |
| 3,600,847 | 8/1971 | Lakin | 446/164 |

FOREIGN PATENT DOCUMENTS

| | | | |
|---|---|---|---|
| 34811 | 12/1964 | German Democratic Rep. | 446/161 |

*Primary Examiner*—Mickey Yu
*Attorney, Agent, or Firm*—Romeny Golant Martin Seldon & Ashen

[57] ABSTRACT

Pontoons along both sides of the vehicle can be filled with either air or water, at the user's preference. When the pontoons are filled with air the vehicle floats in water and is driven along the water surface by a propeller and also by a tread drive. When the pontoons are filled with water the vehicle sinks in water and is driven along the bottom by, again, the propeller and treads. In either event when the vehicle comes to a dry surface it continues to be driven along that surface by the treads. The pontoons are provided with a hole and plug for use in filling or draining them. Preferably the interior spaces of the pontoons communicate through a cross-connection chamber that rougly equalizes the amount of water in the two pontoons, so that the vehicle has minimal tendency to capsize or ride in the water at a cant. An unusual two-worm-and-worm-gear drive train provides power to the tread drivers both fore and aft with high mechanical advantage and very few moving parts. The worm gears slide laterally along the tread-driver axles under action of a manually manipulated shifter, to disengage the worm gears from the worms for free-wheeling unpowered play; the motor power is controlled by the same shifter.

23 Claims, 6 Drawing Figures

FIG. 3
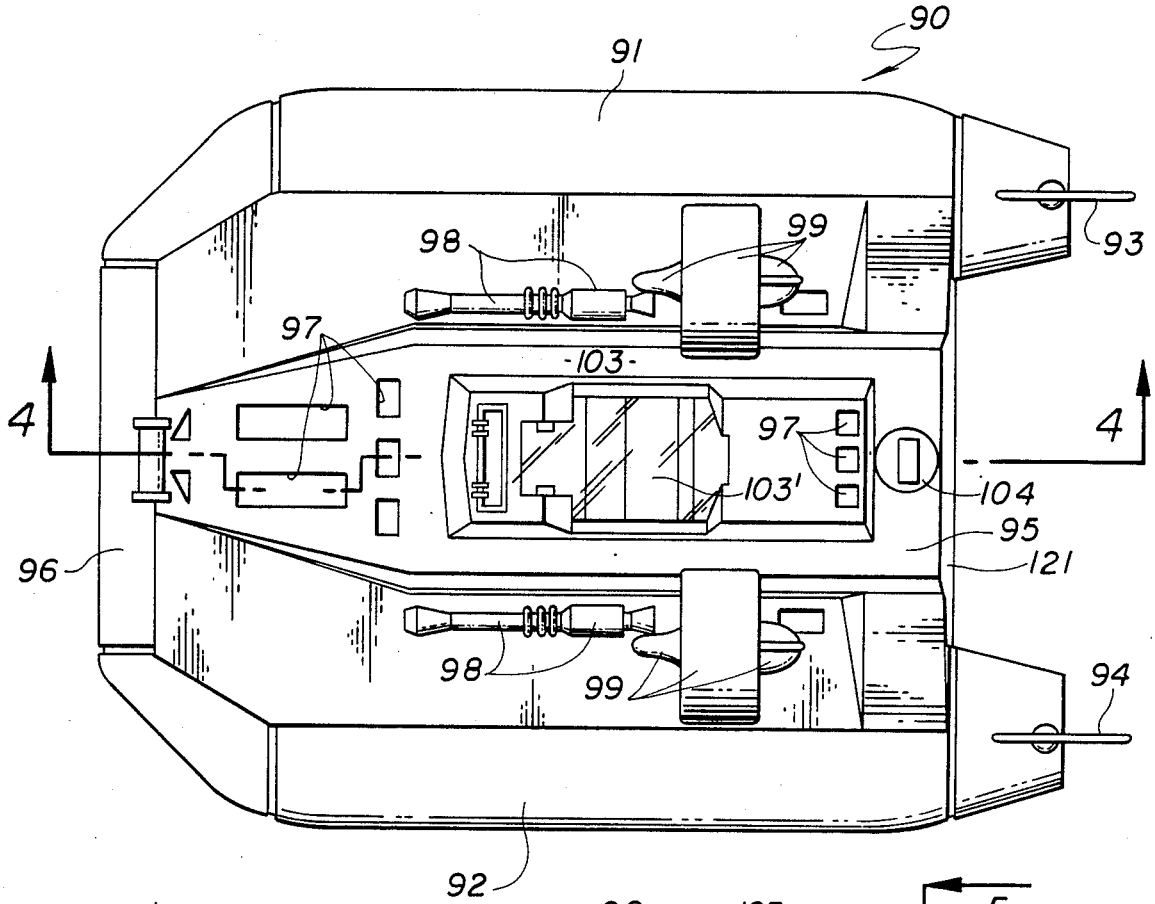
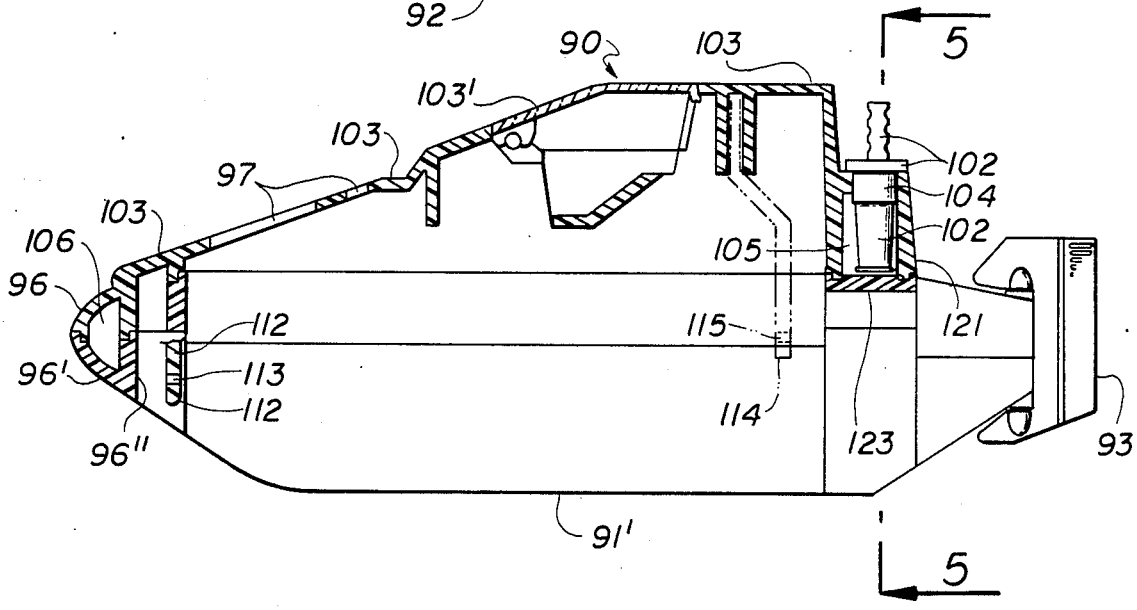
FIG. 4

TOY FOUR-WHEEL-DRIVE CLIMBING VEHICLE OPERABLE ON LAND, OVER WATER, AND UNDER WATER

RELATED APPLICATIONS

This is a continuation-in-part of U.S. patent application Ser. No. 788,052, filed Oct. 16, 1985.

That application was in turn a continuation-in-part of two earlier application Ser. No. 463,999 (filed Feb. 4, 1983 and now issued as U.S. Pat. No. 4,547,166) and 417,554 (filed Sept. 13, 1982 and now issued as U.S. Pat. No. 4,492,058).

The latter was itself a continuation-in-part of application Ser. No. 233,495 (filed Feb. 11, 1981 and now abandoned), which was a continuation-in-part of application Ser. No. 121,645 (filed Feb. 14, 1980 and now issued as U.S. Pat. No. 4,306,375).

All of the teachings of these related applications are hereby incorporated herein by reference.

BACKGROUND

1. Field of the Invention

This invention relates generally to toy vehicles, and more particularly to small-scale self-powered amphibious toy vehicles.

2. Prior Art

Many toy vehicles have been outfitted for locomotion along both dry-land and water surfaces, by provision of flotation chambers.

Such vehicles are quite delightful, because a user can play with them in a greater variety of ways than vehicles that operate only on dry land or only on water. It is especially amusing to watch such toy vehicles scuttle back and forth across the edge of a pond or pool.

When such a vehicle reaches such a body of water, it necessarily floats along the surface by virtue of the buoyancy of the flotation chambers. On the other hand, a vehicle that lacks such chambers, if its working parts are capable of operation under water, will instead move along the bottom of the pool. This too is an amusing and entertaining second mode of "amphibious" operation.

Heretofore it has not been fully practical to enjoy *both* of these two kinds of amphibious or quasi amphibious modes of operation in a single vehicle. Buoyancy is essential to "true" amphibious operation—along a water surface—but it also effectively precludes the second type of amphibious operation that is possible with a nonbuoyant vehicle.

In another (and hitherto unconnected) area of prior art, it is possible that there have been some bathtub-type toy submarines or the like with fillable or partially fillable buoyancy chambers. We are not aware of any such toys capable of self-powered motion through the water—in particular none capable of such motion selectably along the surface or along the bottom of the water—and certainly not any that were capable of motion along a dry-land surface.

Thus in the prior art of self-propelled toy vehicles, as far as we know, none have been operable in more than two of these three "media": dry land, water surface, and water bottom.

BRIEF SUMMARY OF THE DISCLOSURE

The present invention goes beyond the prior art by providing a vehicle that is operable in all three of the "media" enumerated just above.

The invention is an amphibious toy vehicle capable of operating along a solid surface in air and also capable of self-propulsion selectably either (a) along a solid surface that is at the bottom of a body of water or (b) along the top free surface of a body of water.

The vehicle is also capable of self-propulsion continuously over a boundary between such a solid surface in air and such a body of water. In passing over that boundary toward the water, the vehicle uses selectively either the solid bottom or the free top surface of the body of water.

The vehicle is for use with one or more electrical batteries, which for purposes of speaking generally will be called "battery means."

The vehicle includes a chassis, and some means for propulsion of the vehicle along a solid surface. Again for purposes of generality these latter means will be called "wheel means."

The wheel means are rotatably mounted to the chassis and are adapted for propulsion of the vehicle along such a solid surface. The wheel means may take any of a considerable number of particular forms, including among others wheels, treads or tracks, and combinations such as half-track treads at one end of the vehicle and wheels at the other.

The vehicle also includes an electrical motor mounted to the chassis and mechanically connected to drive the wheel means. The vehicle further includes battery-support and connection means adapted to receive the electrical battery means mentioned earlier, and to electrically connect the battery means to power the motor.

The vehicle also has some means for imparting a variable amount of buoyancy to the vehicle. To express this element of the invention in a suitably broad way, these means will be called "variable flotation-chamber means."

The variable flotation-chamber means are mounted to the chassis. The amount of buoyancy they provide varies between (a) a first value that is low enough to cause the vehicle to sink to the solid surface at the bottom of a body of water and (b) a second value that is high enough to cause the vehicle to float along such a top free surface of a body of water.

The present invention also includes some means, which are manually manipulable, for varying the buoyancy of the flotation-chamber means.

By manipulating the buoyancy-varying means, a user may *select* operation of the vehicle either along the solid surface at the bottom of a body of water or along the free surface at the top, at the user's discretion.

By virtue of these various features in combination, the vehicle operates continuously over a boundary between such a solid surface in air and such a body of water—but using *selectably* either the solid bottom or free top surface of the body of water.

The buoyancy-varying means preferably include sealable means for selectably either (a) admitting liquid to the flotation-chamber means to decrease the buoyancy or (b) emptying liquid from the flotation-chamber means to increase the buoyancy. The capacity of the flotation-chamber means must be sufficient to vary the amount of buoyancy between the first and second values mentioned earlier.

These sealable admitting-or-emptying means preferably include at least one manually manipulable valve. This valve when open provides communication between the interior of the flotation-chamber means and the environment outside the flotation-chamber means. When the flotation-chamber means are submerged, opening the valve tends to admit water to the flotation-chamber means. When the flotation-chamber means are out of the water, opening the valve tends to drain water from the flotation-chamber means. When the flotation-chamber means are *partially* submerged, opening the valve tends to adjust the water level in the flotation-chamber means to approximately the same level as the water level just outside the flotation-chamber means.

Our invention also preferably includes a drive screw that is rotatably mounted to the chassis, at a point that is below the free surface of the water when the vehicle is floating along the free surface. The drive screw is mechanically connected to be powered from the motor to propel, or aid in propelling, the toy vehicle relative to a body of water.

Preferably the flotation-chamber means of our invention include at least one pair of pontoons oppositely disposed relative to the chassis. These pontoons may be entirely distinct and sealed from one another, and may have their own respective portions of the admitting-or-emptying means—e.g., may have their own valves—to admit water to or empty water from each of the pontoons of the pair independently.

We consider it preferable, however, that the admitting-or-emptying means admit water to or empty water from both of the pontoons of the pair in common. More specifically, we prefer to provide a common water duct for the pontoons of the pair (or of each pair, if there is more than one pair of pontoons); and to arrange the admitting-or-emptying means so that they admit water to or empty water from this common duct.

We prefer this configuration because in testing of a model with separate pontoons it was noted that there was some difficulty in equalizing the amount of water in the two pontoons. If this difficulty was not adequately overcome, the resulting unequal buoyancy tended to cause the vehicle when riding along the top surface of a body of water to capsize, or at the very least to be awkwardly canted, or when moving along the bottom surface of a body of water to have one side elevated above the bottom.

This undesirable result had not been foreseen in connection with the earliest embodiments of the invention, and when the problem was noted its solution was not immediately clear. It has been found, however, that the common-duct or cross-connection chamber if adequately sized provides an essentially complete solution to the difficulty of equalizing the buoyancy.

We consider this particular feature of some importance since we contemplate that most users of this invention will be young children, whose dexterity and patience may not be up to the task of "fussing" with the process of filling or emptying the pontoons.

All of the foregoing operational principles and advantages of the present invention will be more fully appreciated upon consideration of the following detailed description, with reference to the appended drawings, of which:

BRIEF DESCRIPTION OF THE DRAWINGS

FIG. 3 is a plan view of the vehicle body that is used with the FIG. 1 chassis in a preferred embodiment of our invention.

FIG. 4 is a longitudinal sectional elevation of the same body, taken along the line 4—4 in FIG. 3.

DETAILED DESCRIPTION OF THE PREFERRED EMBODIMENTS

Figure 1:
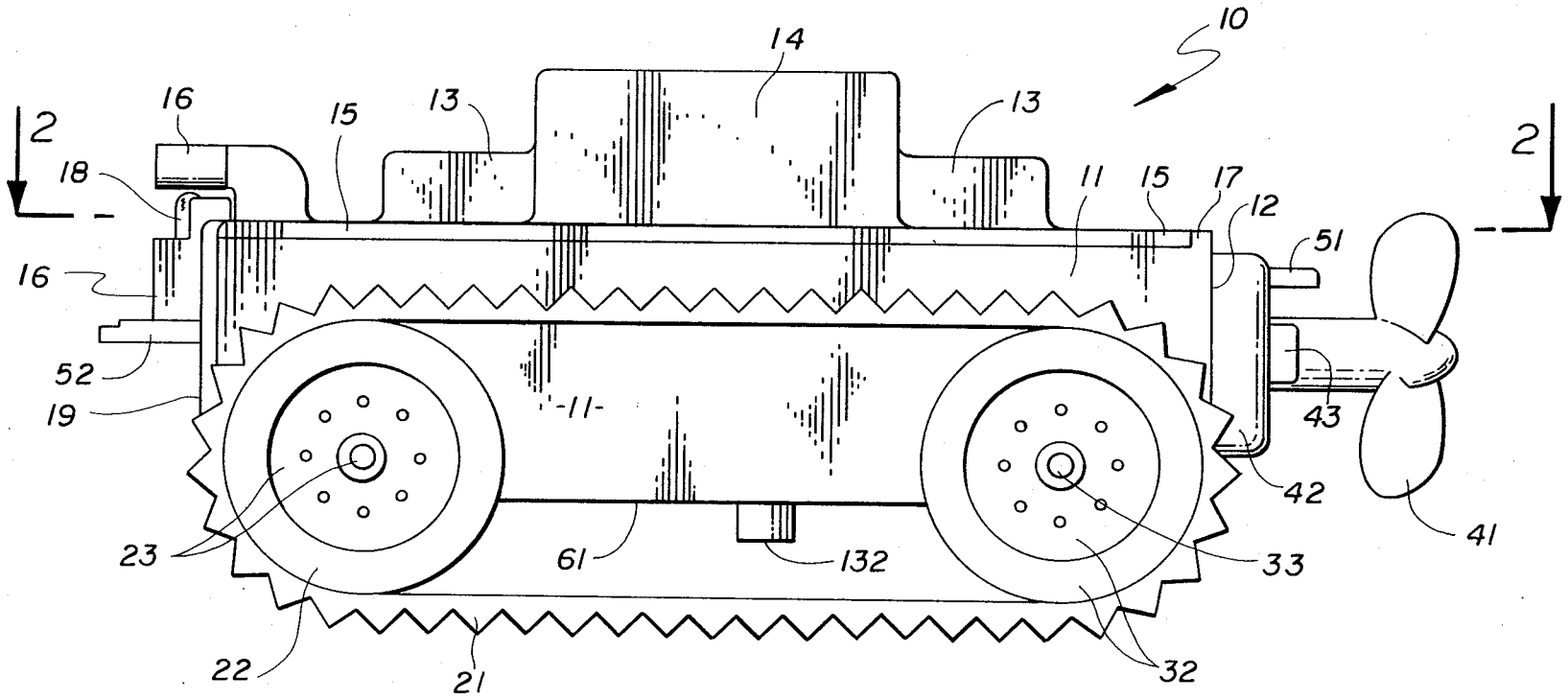
FIG. 1 is a side elevation of the chassis, wheel means, propeller and certain covers of a preferred embodiment of our invention.
Figure 2:
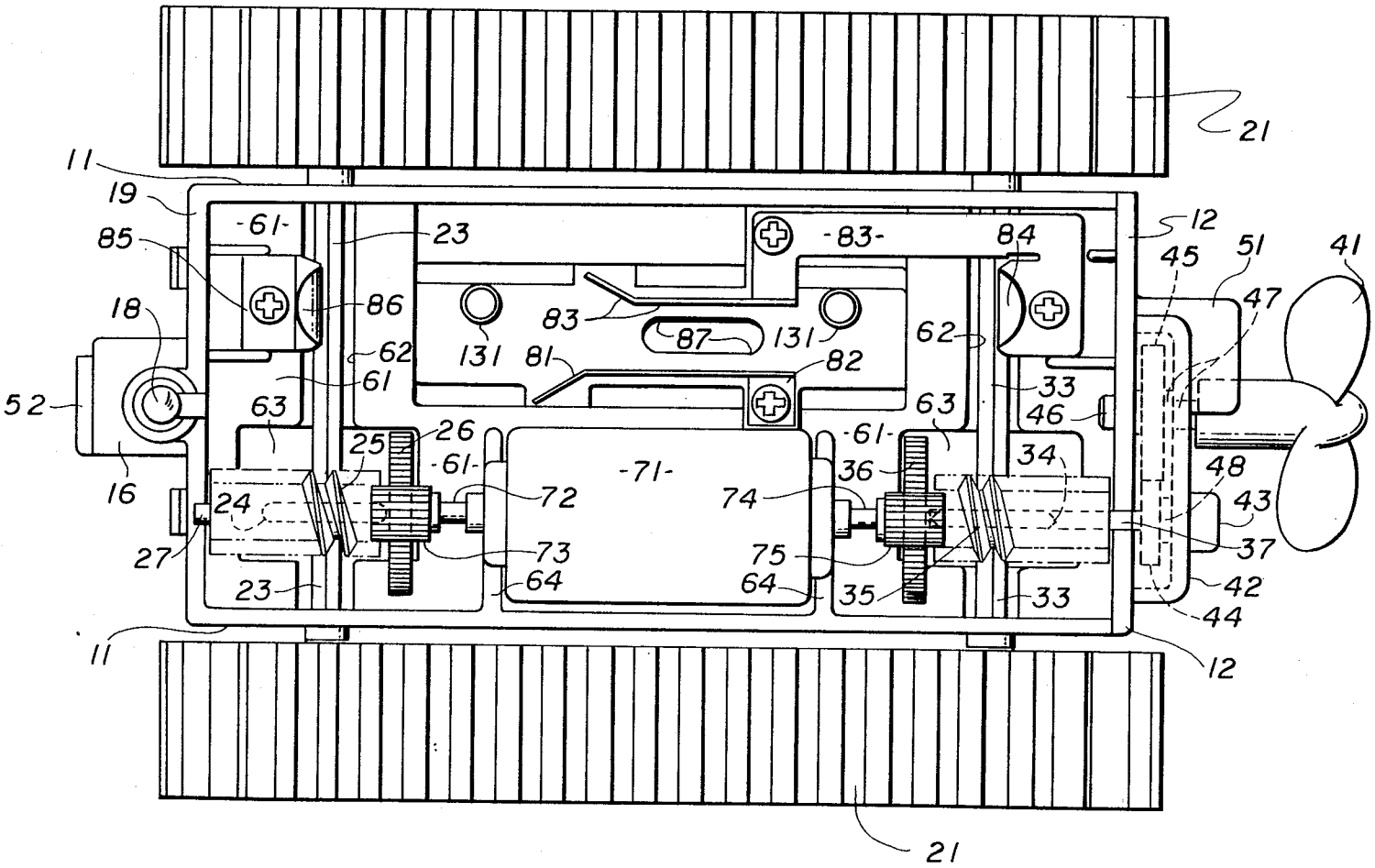
FIG. 2 is a plan view of the same embodiment, taken along the line 2—2 of FIG. 1, showing most of the working parts within the chassis and also showing in dashed lines some portions that are hidden.
Figure 5:
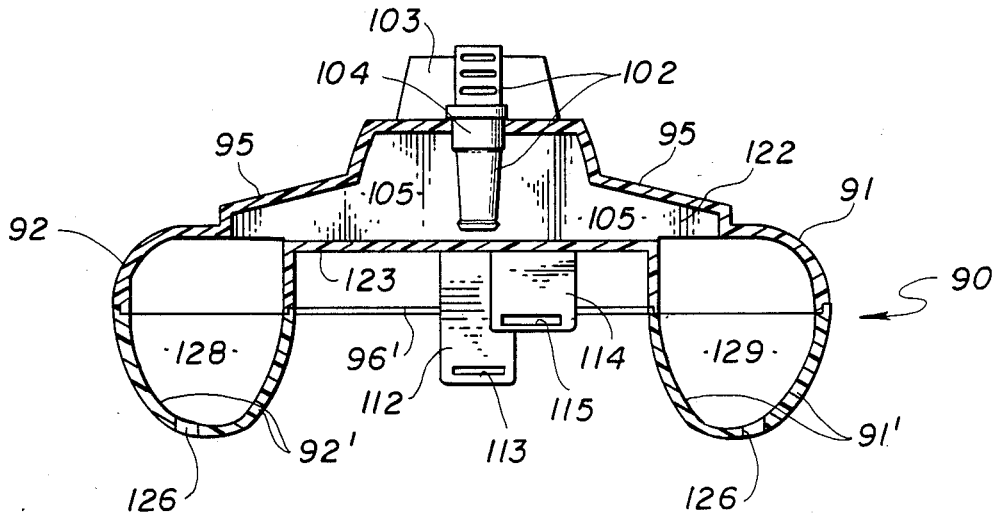
FIG. 5 is a cross-sectional elevation of the FIG. 3 vehicle body, taken along the line 5—5 in FIG. 4.
Figure 6:
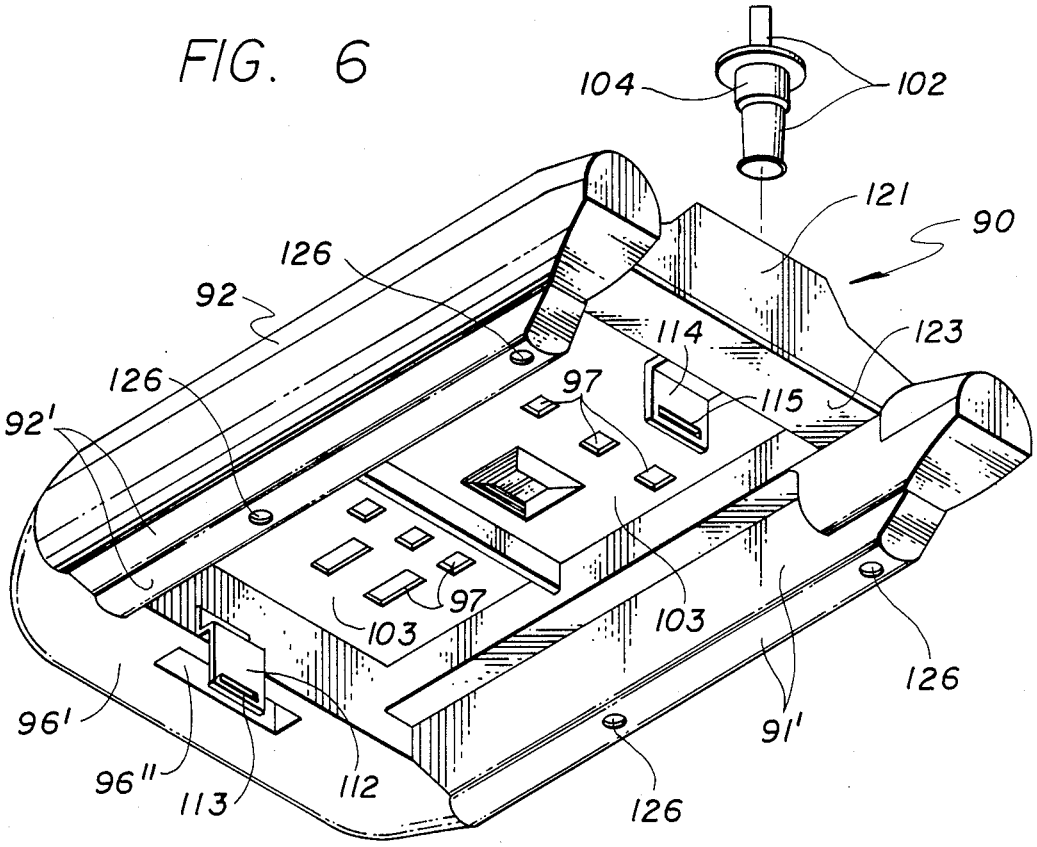
FIG. 6 is a perspective view of the same vehicle body, taken from below and to the left.

As shown in FIGS. 1 and 2, a preferred embodiment of our invention includes a chassis 10 that has a bottom or pan 61, side walls 11 upstanding from the bottom 61, and likewise-upstanding front and rear bulkheads 19 and 12 respectively. Apertures (not shown) through the side walls 11 serve as bearings for rotation of squared off front and rear axles 23 and 33 respectively. To the ends of these axles outside the side walls 11 are fixed respective front and rear pairs of tread drivers 22 and 32.

Mounted over the front and rear tread drivers on each side of the vehicle is an endless track or tread 21, which is driven in the usual fashion when the tread drivers rotate. Mounted for transverse sliding motion along each of the two axles 23, 33—but keyed to the axle and thus constrained to rotate therewith—is a respective worm gear 24, 34.

The axles 23, 33 are recessed in shallow front and rear axle wells 62 below the general level of the chassis pan 61, and the worm gears 24, 34 are similarly recessed in deeper gear wells 63 fore and aft. Mounted for rotation above each worm gear 24, 34 and engageable therewith is a worm-and-spur-gear assembly 25–26, 35–36.

The two worm gears are shown in dashed lines in FIG. 2 since they are below the worms. The worm gears are movable into and out of engagement with their respective worms by sliding along the axles as previously mentioned. Each assembly 25–26, 35–36 may consist either of an integral casting of each worm 25 or 35 with its corresponding spur 26, 36 and corresponding mounting shaft 27, 37—or separately made worms 25, 26 assembled to a common shaft 27, 37 with the corresponding spur 26, 36—or any other expedient combination of separately made components with integral subassemblies.

In any event, the outer end of the worm-and-spur-gear assembly shaft 27 or 37 is journalled in the corresponding end bulkhead 19, 12 of the chassis 10, and the other end (not illustrated) of the shaft 27, 37 is journalled in one of two internal bulkheads 64.

The forward end of the *front*-end worm-and-spur-gear assembly shaft 27 terminates within the front bulkhead 19, but the rearward end of the rear-end worm-and-spur-gear assembly shaft 37 passes entirely through the rear bulkhead 12 into a separately formed gear housing 42. This shaft 37 passes through the gear housing 42 and terminates within a bushing 43 that is formed in the rear or outer wall of the gear housing 42.

Secured to or integral with this end of the shaft 37, within the gear housing 42, is a spur gear 44, which is meshed with another spur gear 45. The latter spur 45 is secured for rotation with a shaft 46–47 whose forward end 46 is journalled in the rear bulkhead 12 and whose rearward end 47 passes through the rear or outer wall of the gear housing 45 and is there secured to or integral with a propeller 41. Thus the propeller is constrained to rotate whenever the worm 35 rotates, regardless of whether the worm gears 24, 34 are engaged with their respective worms 25, 35.

Also mounted to the chassis pan 61 is a small electric motor 71. The drive shaft 72–74 of this motor 71 extends from the motor proper at both ends and is fitted at each end with a corresponding pinion gear 73, 75. These pinions 73, 75 are directly above and continually engaged with the corresponding spur gears 26, 36 previously described. Consequently when the motor is energized to rotate the drive shaft 72–74, that shaft spins the pinions 73, 75, which in turn drive the spurs 26, 36.

As the spurs are secured to or integral with the respective worms 25, 35, these turn as well—the rearward worm 35 also driving the propeller 41 through the external transmission 44–45. If the worm gears 24, 34 are engaged with the worms 25, 35, the worm gears and the axles 23, 33 to which they are keyed rotate as well, operating the tread drivers 23, 33 and treds 21.

The motor is connected electrically between sheet-metal contacts 81–82 and 85–86. An upstanding portion 86 of one of these contacts 85–86 serves as one battery-contact terminal at the front of the chassis 10. A complementary upstand1ng portion 84 of yet another contact 83–84 serves as another battery-contact terminal at the rear of the chassis 10. The overall scale of the chassis 10 may perceived from the fact that these two battery-contact terminals 86 and 84 are spaced apart to receive a single "AA"-size battery—which thus extends longitudinally almost the entire length of the chassis 10.

To complete the circuit and energize the motor 71 it is necessary only to bridge the two contacts 81–82 and 83–84. This function is controllably performed by a sliding switch contact (not illustrated). The sliding contact is a flat piece of sheet metal disposed for longitudinal sliding motion along the pan or bottom 61 of the chassis, in an elongated space defined between the contacts 81–82 and 83–84. This sliding contact has laterally protruding flat ears that engage the inclined upstanding end portion 81 and 83 respectively of the two contacts 81–82 and 83–84.

This sliding contact has guide slots that receive the shallow upstanding pillars 131, to constrain the sliding contact to slide longitudinally. Secured to the underside of the sliding contact is a cylindrical boss that projects downwardly through a slot 87 in the chassis pan 61, and which is terminated below the pan 61 in a switch handle 132 (FIG. 1) which is thus outside the chassis enclosure.

Also beneath the chassis pan 61 and not illustrated is a shifting fork that extends into the worm-gear wells to move the worm gears in and out of engagement with the worms. The shifting fork also has a slot that receives the downward-projecting cylindrical boss from the sliding contact; however, the slot in the shifting fork is at a forty-five-degree angle to the longitudinal dimension of the chassis, and the shifting fork itself is constrained to slide only transversely relative to the chassis.

Longitudinal motion of the switch handle 132 therefore simultaneously moves the switch contact longitudinally and the shifting fork transversely. Hence when the switch handle 132 is moved forward or rearward to disengage or engage the electrical contacts 81, 83—and thus deenergize or energize the motor 71—the same motion respectively disengages or engages the mechanical transmission. In this way the vehicle is rendered freewheeling whenever the power is off.

Also mounted to the chassis and energized in parallel with the motor is an electric light bulb 18, in a mounting and guard assembly 16. The upper (guard) portion of this assembly 16 may be formed in common with the motor cover 14 or the battery cover 13, which snap into place atop the chassis 10 as indicated in FIG. 1.

Many details of our preferred embodiment may be further understood from review of the related patents enumerated above, to the extent that features are similar.

The front and rear bulkheads 19 and 12 carry respective body-mounting bosses 52 and 51, which thus extend fore and aft respectively from the chassis 10. These body-mounting bosses 52, 51 are formed to engage mating bosses 112 and 114, respectively, of an amphibious vehicle body 90 shown in FIGS. 3 through 6. The bosses 112, 114 of the body 90 each define a shallow slot 113, 115 respectively, to receive shallow tongues that are formed at the ends of the chassis-mounted bosses 52, 51. By a very slight deformation of the body-mounted bosses 112, 114 or the body itself, the space between the latter bosses is increased just enough to snap the body in place over the chassis.

The body 90 has a single-thickness deck 103 with various ornamental features such as through holes 97, a fanciful representation of a cockpit 102, weapons 98, fans 99 such as might be employed to drive a ground-effect vehicle, or whatever such features are considered desirable to effectuate a play theme of the vehicle.

At the left and right sides of the vehicle body are formed hollow pontoons 91–91′ and 92–92′. This portion of the body being necessarily two-layered, the structure can be formed of two separately cast half-body portions—e.g., an upper section 91, 92 that is integral with the deck 103, and a lower section 91′, 92′—that are snapped together and sealed by heat, adhesive or other appropriate means. In this way the pontoons define two internal cavities or voids 128, 129 adapted to be filled with either air or water at the preference of the user.

Fins or rudders 93 and 94 are pivotally mounted at the rear of the two pontoons 91 and 92 respectively, for adjustment by a user to control the path of the vehicle in water.

Small holes 126 are formed in the bottom panels 91′, 92′ of the pontoons to admit or drain water. Passage of water through these holes 126 is controlled by inserting or removing a plug 102 that is formed with an upstanding handle and is fitted with a sealing gasket 104.

The presence or absence of the plug 102 controls passage of *air* through the plug aperture, thus controlling in turn whether *water* will flow through the holes 126. When the plug is in place and there is water in the pontoons, if the body is essentially upright there is no significant outward flow of water because any slight outward flow or drip produces a slight partial vacuum that opposes further outward flow. If there is primarily air in the pontoons, placement of the vehicle body upright in water tends to compress the air and so produce an outwardly directed pressure at the holes that opposes inward flow.

In our most highly preferred embodiment, the plug 102 seats in a complementary aperture in the top plate 95 of a common cross-connection or plenum structure 95-121-123. This structure defines a cavity or void 105 that intercommunicates between the pontoon cavities 128 and 129, equalizing the pressure within the two cavities during filling or draining of the pontoons. This rear plenum section 95-121-123 thereby serves to equalize the amount of water taken into or discharged from the two pontoons—provided only that during filling and draining the two pontoons are both placed into and removed from the water at the same times.

An additional cross-connection structure 96–96′–96″ is formed at the front of vehicle body 90, defining another cavity or chamber 106 that also intercommunicates between the pontoon cavities 128 and 129. This chamber 106, being somewhat lower than the rear plenum 105, can be particularly helpful in equalizing the amount of water in the two pontoon chambers by actual flow of water between the chambers after the plug 102 has been seated in its aperture.

Another embodiment of our invention that is slightly less preferred involves use of a separate plug 102 and corresponding aperture in each pontoon 91, 92—and sealing the pontoons from one another. That is to say, in the alternative embodiment here under discussion either there is no cross-connection chamber 105, 106 or the chambers 105, 106 are blocked or sealed to prevent air and water flow between them.

Such an embodiment may be preferred by some users for the special effects that result from unequal bouyancy, particularly if the play theme of the toy vehicle is selected and elaborated in such a way as to capitalize on such special effects.

It will be understood that the foregoing disclosure is intended to be merely exemplary, and not to limit the scope of the invention—which is to be determined by reference to the appended claims.

We claim:

1. An amphibious toy vehicle capable of operating along a solid surface in air and also capable or self-propulsion selectively either (a) along a solid surface that is at the bottom of a body of water or (b) along the top free surface of a body of water; said vehicle also being capable of self-propulsion continuously over a boundary between such a solid surface in air and such a body of water, using selectably either such solid bottom or free top surface of such body of water; said vehicle being for use with electrical battery means, and comprising:

a chassis;

wheel means rotatably mounted to the chassis and adapted for propulsion of the vehicle along a solid surface;

an electrical motor mounted to the chassis and mechanically connected to drive the wheel means;

battery-support and connection means adapted to receive such electrical battery means and to electrically connect the battery to power the motor;

a separate stylized vehicle body configured to represent an amphibious vehicle and comprising variable flotation-chamber means, removably mounted to the chassis and imparting a variable amount of buoyancy to the vehicle, sdid amount of buoyancy varying between (a) a first value that is low enought to cause the vehicle to sink to such solid surface at the bottom of a body of water and (b) a second value that is high enough to cause the vehicle to float along such a top free surface of a body of water; and manually manipulable means for varying the buoyancy of the flotation-chamber means in said removably mounted separate body;

whereby a user by manipulating the buoyancy-varying means in the removably mounted separate body may select operation of the vehicle either along such solid surface at the bottom of a body of water or along such free surface at the top, at the user's discretion; and whereby the vehicle operates continuously over a boundary between such a solid surface in air and such a body of water, but using selectably either such solid bottom or free top surface of such body of water.

2. The toy vehicle of claim 1, wherein:

the buoyancy-varying means comprise sealable means for selectably either (a) admitting liquid to the flotation-chamber means to decrease the buoyancy or (b) emptying liquid from the flotation-chamber means to increase the buoyancy; and the capacity of the flotation-chamber means is sufficient to vary the amount of buoyancy between said first and second values.

3. The toy vehicle of claim 2, wherein:

the sealable admitting-or-emptying means comprise at least one manually manipulable valve that, when open, provides communication between the interior of the flotation-chamber means and the environment outside the flotation-chamber means.

4. The toy vehicle of claim 3, wherein:

the flotation-chamber means comprises at least one watertight wall; and the valve comprises at least one orifice defined in the at least one wall, and a watertight plug adapted to be selectably either removed from or replaced in the orifice.

5. The toy vehicle of claim 1, further comprising a drive screw that is:

rotatably mounted to the chassis, at a point that is below such free surface when the vehicle is floating along such free surface; and mechanically connected to be powered from the motor to propel the toy vehicle relative to such a body of water.

6. The toy vehicle of claim 2, further comprising a drive screw that is:

rotatably mounted to the chassis, at a point that is below such free surface when the vehicle is floating along such free surface; and mechanically connected to be powered from the motor to propel the toy vehicle relative to such a body of water.

7. The toy vehicle of claim 3, further comprising a drive screw that is:

rotatably mounted to the chassis, at a point that is below such free surface when the vehicle is floating along such free surface; and mechanically connected to be powered from the motor to propel the toy vehicle relative to such a body of water.

8. The toy vehicle of claim 4, further comprising a drive screw that is:

rotatably mounted to the chassis, at a point that is below such free surface when the vehicle is floating along such free surface; and mechanically connected to be powered from the motor to propel the toy vehicle relative to such a body of water.

9. The toy vehicle of claim 2, wherein:

the flotation-chamber means comprise at least one pair of pontoons oppositely disposed relative to the chassis;

whereby the buoyancy imparted to the vehicle by the flotation-chamber means produces paired upward forces that are widely separated from one another to give lateral stability to the vehicle; and the admitting-or-emptying means admit water to or empty water from both of the pontoons of said pair in common;

wherein values of buoyancy intermediate between the first and second values, achieved by partial filling of the pontoons with water, produces paired upward forces that are also laterally balanced to effectively level the vehicle.

10. The toy vehicle of claim 9, wherein:

the pontoons of said at least one pair have a common water duct that communicates between them, and the admitting-or-emptying means admit water to or empty water from the common duct;

whereby production of said laterally balanced paired upward forces is particularly facilitated.

11. The toy vehicle of claim 3, wherein:

the flotation-chamber means comprise at least one pair of pontoons oppositely disposed relative to the chassis;

whereby the buoyancy imparted to the vehicle by the flotation-chamber means produces paired upward forces that are widely separated from one another to give lateral stability to the vehicle; and the admitting-or-emptying means admit water to or empty water from both of the pontoons of said pair in common;

whereby values of buoyancy intermediate between the first and second values, achieved by partial filling of the pontoons with water, produces paired upward forces that are also laterally balanced to effectively level the vehicle.

12. The toy vehicle of claim 11, wherein:

the pontoons of said at least one pair have a common water duct that communicates between them, and the admitting-or-emptying means admit water to or empty water from the common duct;

whereby production of said laterally balanced paired upward forces is particularly facilitated.

13. The toy vehicle of claim 4, wherein:

the flotation-chamber means comprise at least one pair of pontoons oppositely disposed relative to the chassis;

whereby the buoyancy imparted to the vehicle by the flotation-chamber means produces paired upward forces that are widely separated from one another to give lateral stability to the vehicle; and the admitting-or-emptying means admit water to or empty water from both of the pontoons of said pair in common;

whereby values of buoyancy intermediate between the first and second values, achieved by partial filling of the pontoons with water, produces paired upward forces that are also laterally balanced to effectively level the vehicle.

14. The toy vehicle of claim 13, wherein:

the pontoons of said at least one pair have a common water duct that communicates between them, and the admitting-or-emptying means admit water to or empty water from the common duct;

whereby production of said laterally balanced paired upward forces is particularly facilitated.

15. The toy vehicle of claim 2, wherein:

the flotation-chamber means comprise at least one pair of pontoons that are oppositely disposed relative to the chassis and that are distinct and sealed from one another; and the admitting-or-emptying means admit water to or empty water from each of the pontoons of said pair independently.

16. The toy vehicle of claim 3, wherein:

the flotation-chamber means comprise at least one pair of pontoons that are oppositely disposed relative to the chassis and that are distinct and sealed from one another; and the admitting-or-emptying means admit water to or empty water from each of the pontoons of said pair independently.

17. The toy vehicle of claim 4, wherein:

the flotation-chamber means comprise at least one pair of pontoons that are oppositely disposed relative to the chassis and that are distinct and sealed from one another; and the admitting-or-emptying means admit water to or empty water from each of the pontoons of said pair independently.

18. The toy vehicle of claim 5, wherein:

the flotation-chamber means comprise at least one pair of pontoons that are oppositely disposed relative to the chassis and that are distinct and sealed from one another; and the admitting-or-emptying means admit water to or empty water from each of the pontoons of said pair independently.

19. The toy vehicle of claim 6, wherein:

the flotation-chamber means comprise at least one pair of pontoons that are oppositely disposed relative to the chassis and that are distinst and sealed from one another; and the admitting-or-emptying means admit water to or empty water from each of the pontoons of said pair independently.

20. The toy vehicle of claim 1, particularly for use on such solid surfaces that are irregular, both in air and along the bottom of such a body of water; and wherein:

the wheel means comprise cleats for propulsion of the vehicle along such free top surface of a body of water, and also to facilitate propulsion of the vehicle along such irregular solid surfaces.

21. The toy vehicle of claim 2, particularly for use on such solid surfaces that are irregular, both in air and along the bottom of such a body of water; and wherein:

the wheel means comprise cleats for propulsion of the vehicle along such free top surface of a body of water, and also to facilitate propulsion of the vehicle along such irregular solid surfaces.

22. The toy vehicle of claim 5, particularly for use on such solid surfaces that are irregular, both in air and along the bottom of such a body of water, wherein:

the wheel means comprise cleats to assist the screw in propulsion of the vehicle along such free top surface of a body of water, and also to facilitate propulsion of the vehicle along such irregular solid surfaces.

23. The toy vehicle of claim 6, particularly for use on such solid surfaces that are irregular, both in air and along the bottom of such a body of water, wherein:

the wheel means comprise cleats to assist the screw in propulsion of the vehicle along such free top surface of a body of water, and also to facilitate propulsion of the vehicle along such irregular solid surfaces.

* * * * *